US006857303B2

(12) United States Patent
Latour

(10) Patent No.: US 6,857,303 B2
(45) Date of Patent: Feb. 22, 2005

(54) MACHINE FOR BENDING AND TWISTING FLAT METAL WIRE

(75) Inventor: Yves Latour, Haraucourt (FR)

(73) Assignee: Ateliers de Constructions Mecaniques Latour et Fils, Bazeilles (FR)

( * ) Notice: Subject to any disclaimer, the term of this patent is extended or adjusted under 35 U.S.C. 154(b) by 0 days.

(21) Appl. No.: 10/239,733

(22) PCT Filed: Apr. 4, 2001

(86) PCT No.: PCT/FR01/01009

§ 371 (c)(1),
(2), (4) Date: Sep. 25, 2002

(87) PCT Pub. No.: WO01/74512

PCT Pub. Date: Oct. 11, 2001

(65) Prior Publication Data

US 2003/0029215 A1 Feb. 13, 2003

(30) Foreign Application Priority Data

Apr. 4, 2000 (FR) ..... 00 04272

(51) Int. Cl.[7] ..... B21D 11/14
(52) U.S. Cl. ..... 72/307; 72/299; 72/371
(58) Field of Search ..... 72/307, 306, 371, 72/299, 168

(56) References Cited

U.S. PATENT DOCUMENTS

| | | | | |
|---|---|---|---|---|
| 2,711,553 A | | 6/1955 | O'Shei | |
| 3,580,039 A | * | 5/1971 | Heinonen | 72/371 |
| 4,367,641 A | | 1/1983 | Mizutani | |
| 4,391,116 A | * | 7/1983 | Yogo | 72/168 |
| 4,471,819 A | | 9/1984 | Nihashi | |
| 4,656,860 A | * | 4/1987 | Orthuber et al. | 72/299 |
| 5,239,850 A | * | 8/1993 | Shimokata | 72/168 |
| 5,425,257 A | * | 6/1995 | Kitsukawa et al. | 72/168 |
| 5,884,517 A | * | 3/1999 | Yogo | 72/307 |

* cited by examiner

*Primary Examiner*—Daniel C. Crane
(74) *Attorney, Agent, or Firm*—Harrison & Egbert

(57) ABSTRACT

A machine for bending and twisting flat metal wire for producing a motor vehicle wiper arm. The machine includes device for feeding and maintaining the wire, and at least a mechanism capable of gripping and releasing the wire in output of the feeding and maintaining device, and which is, under the action of a driver associated with a transmission device, mobile in several directions, rotating about the axis moving the wire, and moving, in one direction or another, in a direction perpendicular to the surfaces of the wire.

4 Claims, 1 Drawing Sheet

MACHINE FOR BENDING AND TWISTING FLAT METAL WIRE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

1. Field of the Invention

The present invention relates to a machine for bending and twisting flat metal wire, namely for producing a wiper arm for a motor vehicle.

2. Background of the Invention

The arm of a wiper is made through bending a flat metal wire, e.g. with a substantially rectangular or similar cross-section, in order to enable it to withstand the stresses it is subjected to, and for ensuring the perfect maintaining off the wiper brush, which can thus not rotate about said wire. This metal wire is bent in order to, on the one hand, allow it matching, at a distance, the contours of the vehicle and, on the other hand, give it the best-adapted orientation, so that the brush is perfectly applied against the window during its alternating movement.

However, due to the substantially rectangular cross-section of the wire, the latter can be bent only in two opposite directions, which correspond to the two large sides; therefore, in order to bend the wire in other directions, it is necessary to associate the bending with a twisting of the wire.

Carrying out the bend or bends or the twist or twists has drawbacks, since it is difficult to make a twist on a wire that is already bent, or inversely, due to which said bends or twists are not made perfectly, which can give rise to adjusting problems when mounting the wiper arms.

BRIEF SUMMARY OF THE INVENTION

The present invention is aimed at coping with this drawback by providing a machine allowing to continuously carry out bends and twists, alternately and eventually simultaneously.

The machine for bending and twisting flat metal wire, namely for producing a wiper arm for a motor vehicle object of the present invention is mainly characterized in that it includes means for feeding and maintaining the wire, and at least means capable of gripping and releasing said wire at the outlet of said feeding and maintaining means and which is, under the action of driving means associated with transmission means, mobile in several directions, on the one hand, rotating about the axis of displacement of said wire and, on the other hand, in displacement, in one direction or another, in a direction perpendicular to the surfaces of said wire.

The various movements the means capable of gripping the wire at the outlet of the feeding and maintaining means allow carrying out bends and twists on a wire.

Thus, the rotation about an axis of displacement of the wire allows twisting it, while the displacement, in one direction or another, perpendicular to the surfaces of said wire allows carrying out the bending.

According to an additional feature of the machine according to the invention, the means capable of gripping and releasing the wire at the outlet of said feeding and maintaining means is capable of almost getting into contact with the end portion of the means for feeding and maintaining said wire.

According to another additional feature of the machine according to the invention, the means capable of gripping and releasing the wire at the outlet of the feeding and maintaining means is mobile in rotation about an axis radial to the axis of displacement of said wire and parallel to the surfaces of the latter.

Such a displacement in rotation of the means capable of gripping and releasing the wire at the outlet of the means for feeding and maintaining said wire allows performing the motion for bending the wire.

According to another additional feature of the machine according to the invention, the means capable of gripping and releasing the wire at the outlet of the means for feeding and maintaining the wire consists of means mobile in axial displacement along an axis radial to the axis of displacement of said wire and parallel to the surfaces of the latter.

The axial movement of the means capable of gripping and releasing the wire at the outlet of the means for feeding and maintaining said wire allows said means to disengage after a bending and/or twisting operation.

According to a particular embodiment of the machine for bending and twisting according to the invention, the means capable of gripping and releasing the wire at the outlet of the feeding and maintaining means are in the form of a strap aimed at straddling, through an axial motion, said wire, said strap including two parallel legs separated by a gap the width of which corresponds to the thickness of said wire.

According to a preferred embodiment of the machine for bending and twisting according to the invention, it includes a body with an annular shape, positioned about the means for feeding and maintaining said wire, capable of rotating axially about the axis of displacement of the wire, and on the edge of which is mounted a tool-holder capable of causing a tool to rotate about an axis radial to said axis of displacement of the wire and parallel to the surfaces of the latter, and capable of allowing said tool to disengage from said wire.

The advantages and features of the machine according to the invention will become more evident from the following description referring to the attached drawing, which represents a non-restrictive embodiment of it.

BRIEF DESCRIPTION OF THE SEVERAL VIEWS OF THE DRAWINGS

In the attached drawing, the single

DETAILED DESCRIPTION OF THE INVENTION

Figure 1:
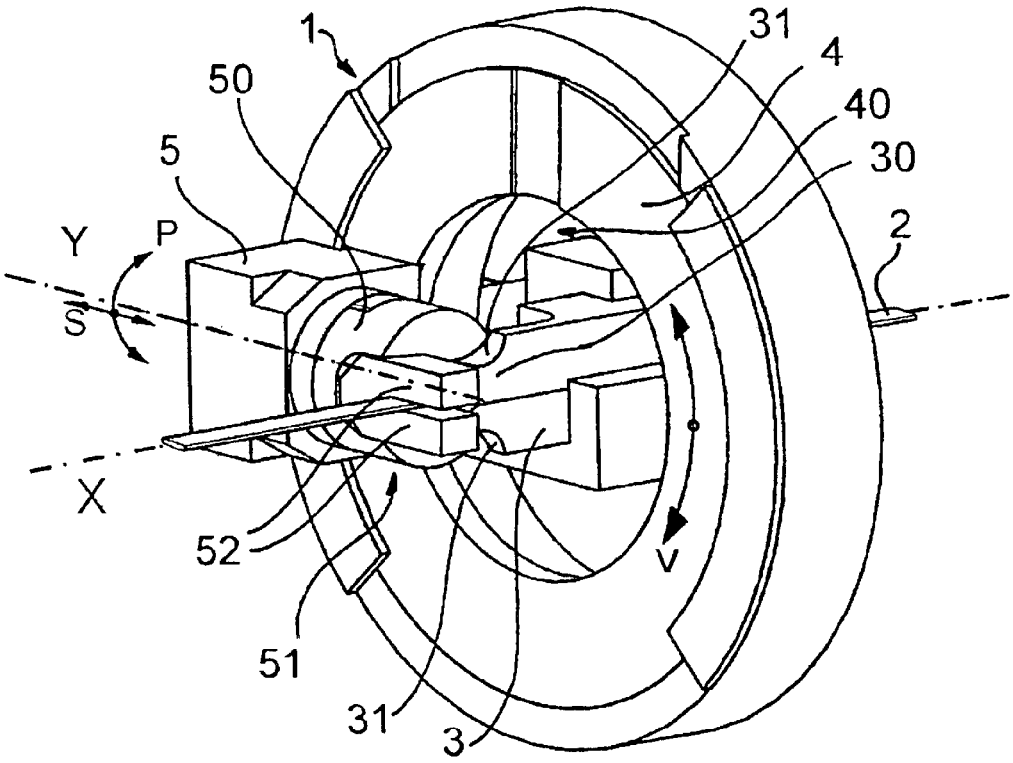
FIG. 1 is a partial schematic perspective view of a machine for bending and twisting flat metal wire, namely for producing a wiper arm for a motor vehicle, according to the invention.

Referring to FIG. 1, the bending head of a machine according to the invention for bending and twisting a wire 2 can be seen with a rectangular cross-section, which thus has two surfaces 20.

The wire 2 is maintained by a feeding and maintaining means 3 capable of axially driving, according to an axis X, and of immobilizing the wire 2.

The bending head 1 includes a body 4 in the shape of a ring, in the opening 40 of which passes the end portion 30 of the feeding and maintaining means 3, only part of which can be seen. The body is mobile in rotation according to the double arrow V, about the axis X, under the action of driving means associated with transmission means, not shown.

The body 4 bears a member 5 in which a tool-holder 50 can rotate along an axis Y radial to the axis X and parallel to the surfaces 20 of the wire 2 and which preferably passes not far from the end, not visible, of the means for feeding and maintaining 3 the wire 2, the rotation of the tool-holder 50 being shown by a double arrow P.

The tool-holder 50 bears, eccentrically with respect to the axis Y, a tool 51 in the form of a strap that thus includes two legs 52 separated by a gap of a width slightly larger than the thickness of the wire 2. In addition, the tool 51 is mobile in axial displacement, parallel to the axis T, this displacement being shown by a double arrow S.

It should be noted that the axial motion of the tool 51 can be carried out either through its displacement within the tool-holder 50 or through moving the latter within the member 5 or through moving the member 5 along the body 4.

It should also be noted that, when the axial motion of the tool 51 is performed through moving it within the tool-holder 50, it is possible for the latter to include several tools having different characteristics, e.g. dimensional characteristics, each one being capable of being extracted according to the nature of the bending to be performed.

It should be noted that, in a variant, not shown, the twisting motion along a V is performed through moving the member 5 along the body 4, e.g. by means of a rack system.

Carrying out a bend on the wire 2 occurs as follows: the wire 2 is moved along X, by a desired length, then it is maintained by the feeding and maintaining means 3, while the tool 51 is brought closer to the wire 2 and its two legs 52 straddle it in the vicinity of the end portion 30 of the feeding means 3. Because of the axial rotation of the tool-holder 50 along Y, the rotation P of the tool then allows performing the bending of the wire 2.

It should be noted that the radius of rotation of the tool 51 along Y is preferably small, therefore, the end portion 30 has backlashes 31 allowing the passing-through of the tool 51.

Since the wire 2 is bent and maintained in the tool 51, it is neither possible to move it along X, nor to cause the tool 51 to rotate; therefore, the latter is moved axially along S, then brought back into its initial position, thus allowing the wire 2 to be released.

To perform a twist on the wire 2, one proceeds, in a first step, as follows, i.e., after moving the wire 2 along X, blocking the latter in the feeding and maintaining means, and placing the tool astraddle on the wire 2, a twist is performed through rotating the body along V, further bending also being subject to the axial release of the tool 51.

The machine according to the invention allows concatenating the bending and twisting motions, these motions being of course performed through numerically controlled stepping motors.

I claim:

1. A machine for bending flat metal wire comprising:

a means for feeding and maintaining the wire, said means for feeding and maintaining having an outlet; and a means for gripping and releasing the wire positioned at said outlet, said means for gripping and releasing being drivably mobile in a first direction so as to rotate about a first axis along which said means for feeding and maintaining feeds the wire, said means for gripping and releasing being drivably mobile in a direction that is perpendicular to said first axis, said means for gripping and releasing being drivably mobile in rotation about a second axis which is radial to said first axis and in parallel relation to surface of the wire, said means for gripping and releasing comprising:

a body having an annular shape and positioned around said means for feeding and maintaining, said body rotatable about said first axis;

a tool holder mounted to an edge of said body; and a tool received in said tool holder, said tool holder capable of rotating said tool about said second axis and capable of causing said tool to disengage from the wire.

2. The machine of claim 1, said means for gripping and releasing the wire being adjacent an end portion of said means for feeding and maintaining the wire.

3. The machine of claim 1, said means for gripping and releasing being mobile in axial displacement along said second axis and in parallel relation to the surface of the wire.

4. The machine of claim 1, said means for gripping and releasing comprising a strap positioned so as to straddle the wire, said strap having a pair of parallel legs spaced from each other by a gap having a width corresponding to a thickness of the wire.

* * * * *